US005464481A

United States Patent [19]

Lietz, Jr. et al.

[11] Patent Number: 5,464,481

[45] Date of Patent: Nov. 7, 1995

[54] SATELLITE DISH CLEANING APPARATUS AND METHODS

[76] Inventors: Paul P. Lietz, Jr., 6102 Azure Meadow Dr., Salt Lake City, Utah 84118; Michael J. Foster, 9107 Shad Cir., Sandy, Utah 84079

[21] Appl. No.: 304,269

[22] Filed: Sep. 12, 1994

[51] Int. Cl.[6] ..... A46B 15/00; A47L 13/02; A47L 13/11

[52] U.S. Cl. ..... 134/6; 15/160; 15/236.07; 15/245; 15/144.4; 15/145

[58] Field of Search ..... 15/160, 162, 164, 15/201, 210.1, 211, 214, 236.01, 236.04, 236.07, 242, 244.1, 245, 245.1, 144.4, 145; 134/6

[56] References Cited

U.S. PATENT DOCUMENTS

| | | | |
|---|---|---|---|
| D. 30,404 | 3/1899 | Booker | 15/245 |
| 300,447 | 6/1884 | Cornelius | 15/245 |
| 499,060 | 6/1893 | Unsinger | 15/245 |
| 1,000,737 | 8/1911 | MacLennan | 15/242 |
| 1,264,350 | 4/1918 | Unsinger | 15/236.07 |
| 1,629,309 | 5/1927 | Rohrke | 15/242 |
| 1,789,636 | 1/1931 | Oberti | 15/245 |
| 2,045,762 | 6/1936 | Elliott | 15/245 |
| 2,202,695 | 5/1940 | Kinney | 15/160 |
| 2,236,123 | 3/1941 | Von Pierce | 15/242 |
| 2,259,699 | 10/1941 | Larson | 15/214 |
| 2,265,551 | 12/1941 | Steccone | 15/245 |
| 2,273,561 | 2/1942 | Cenis | 15/236.01 |
| 2,347,963 | 5/1944 | O'Neill | 15/245 |
| 2,732,574 | 1/1956 | Gesell et al. | 15/210.1 |
| 2,790,193 | 4/1957 | Wilding | 15/210.1 |
| 2,817,867 | 12/1957 | Bugbird | 15/160 |
| 2,826,774 | 3/1958 | Skrainka | 15/160 |
| 2,878,501 | 3/1959 | Brennan | 15/164 |
| 2,880,441 | 4/1959 | Rushing, Jr. | 15/214 |
| 3,091,791 | 6/1963 | Czapar, Jr. | 15/245 |
| 3,108,303 | 10/1963 | Unterbrink et al. | 15/210.1 |
| 3,187,362 | 6/1965 | Garrett | 15/210.1 |
| 3,296,643 | 1/1967 | Fortune | 15/201 |
| 3,483,643 | 12/1969 | Wenzel | 37/53 |
| 3,613,144 | 10/1971 | Wetherill | 15/210.1 |
| 4,325,157 | 4/1982 | Balint et al. | 15/144.4 |
| 4,355,432 | 10/1982 | Storm, Jr. | 15/245 |
| 4,703,535 | 11/1987 | Nehls | 15/160 |
| 4,850,728 | 7/1989 | Arroyo | 15/236.07 |

FOREIGN PATENT DOCUMENTS

| | | | |
|---|---|---|---|
| 508669 | 10/1920 | France | 15/164 |
| 1174511 | 11/1958 | France | 15/160 |
| 837457 | 4/1952 | Germany . | |
| 2645188 | 4/1978 | Germany | 15/210.1 |
| 144804 | 4/1954 | Sweden | 15/236.01 |
| 287109 | 8/1928 | United Kingdom | 15/211 |
| 568829 | 4/1945 | United Kingdom | 15/236.01 |
| 1418462 | 12/1975 | United Kingdom | 15/160 |

*Primary Examiner*—Mark Spisich

*Attorney, Agent, or Firm*—Berne S. Broadbent; Gary D. E. Pierce

[57] ABSTRACT

A satellite dish cleaning apparatus and method is disclosed in one preferred embodiment of the present invention as including a handle member removably disposed within an elongated opening integrally formed at a first end of an intermediate member. The intermediate member is preferably formed having a substantially curvilinear neck portion extending substantially at an angle between approximately 10° to 170° from the first end to a second end of the intermediate member. Preferably, formed at the second end of the intermediate member is a retaining assembly for removably retaining a first end of a satellite dish engaging member. In addition, formed at a second end of the satellite dish engaging member is a contacting surface having a configuration substantially conforming with the concave facing surface of a satellite dish. In the preferred embodiment, the contacting surface of the removable satellite dish engaging member may comprise, for example, a rigid angular scraping and/or scooping means, a cleaning brush, or a resilient, elastomeric material.

7 Claims, 2 Drawing Sheets

SATELLITE DISH CLEANING APPARATUS AND METHODS

BACKGROUND

1. The Field of the Invention

This invention relates to cleaning devices and, more particularly, to a novel satellite dish cleaning apparatus and methods for removing accumulations of dust, debris, snow and/or ice from the concave facing of a satellite dish.

2. The Background Art

Cleaning implements for removing accumulations of dust, debris, water, snow and/or ice from windshields or windows to improve visual acuity and perception, from sidewalks and roadways to reduce the danger of slipping or falling, etc. have become valuable instruments or tools when dealing with the consequences of nature. Although various cleaning implements have been developed by those skilled in the art, none of the prior art cleaning devices are commercially practical for the intended purpose of removing dust, debris, snow and/or ice from the concave facing of a satellite dish.

Presently, one of the most indispensable pieces of equipment utilized within the telecommunications industry today involves orbiting satellite transmission systems having the capability of delivering visual text, graphics, scientific data, audio messages, etc. to satellite dish receivers remotely positioned throughout the world. Accordingly, the concave configuration of the facing of a satellite dish receiver is typically aligned, with some degree of precision, in an angle respective of a satellite's orbiting position in space in order to receive signals transmitted therefrom. Correspondingly, the slightest modification or negligible adjustment in the angular receiving position of the concave facing surface of the satellite dish will generally affect the strength and quality of the reception of the transmission signal being relayed by the orbiting satellite.

Since satellite dish receivers are typically installed outdoors, a satellite dish receiver is usually exposed to the unforgiving elements of nature such as, for example, dust, debris, water, snow and ice. Accordingly, when the elements of nature begin to accumulate on the exterior surface of a satellite dish, serious reception problems typically result. For example, the weight of an accumulation of debris, snow or ice will generally cause a misalignment of the satellite dish thereby resulting in poor or lost reception of the transmission signals from the orbiting satellite. Similarly, if structural damage to the support member sustaining the satellite dish of the ground occurs as a result of the excessive weight of an accumulation of debris, snow and/or ice, a substantial reduction in the reception quality of the satellite transmission system will usually result. Consistent therewith, a cleaning implement capable of removing dust, debris, snow and/or ice from the concave receiving surface of satellite dish has become a virtual necessity for maintaining maximum reception quality of a satellite receiving system.

In an attempt to facilitate receiving quality and transmission clarity, satellite owners typically use conventional brooms to remove accumulations of dust, debris, snow and/or ice from the concave facing of the satellite dish. Significantly, however, one serious disadvantage with using conventional brooms to remove dust, debris, snow and/or ice from the facing of a satellite dish is that the substantially linear configuration of the broom handle in combination with the longitudinally attached whisk portion makes almost any cleaning motion awkward and/or difficult when trying to hold the broom at a substantially vertical angle to the concave surface of the satellite dish in order to accommodate a proper contacting force against the facing of the satellite dish.

In addition, using a conventional prior art broom having a vertically extending handle member to clean the surface of a satellite dish may cause significant damage to the receiving nose cone that extends substantially outward from the facing of the satellite dish and functionally operates to receive and demodulate the transmission signals reflected by the concave facing of the satellite dish. In this regard, damage to the nose cone of the satellite system will generally affect the overall receiving and demodulating quality of the satellite system. Moreover, since the whisk of a conventional prior art broom is usually composed of a plurality of flexible fibrous materials, prior art brooms are generally incapable of removing heavy accumulations of dust, debris, snow and/or ice from the concave surface of the satellite dish.

Alternatively, scraper devices were developed by those skilled in the art to assist users when removing accumulations of snow or ice formed on relatively flat surfaces. Typically, prior art scrapers are formed of a non-resilient material having a linearly, extending blade portion mounted on a relatively short handle member. Prior art scrapers, however, are not typically formed having a complimentary configuration for cleaning the concave shape of the facing of a satellite dish. Moreover, the exterior surface of a satellite dish being typically formed of a soft metal, such as aluminum, may become seriously damaged by the scraping action of a relatively sharp edge formed on the contacting end of scrapers of the prior art.

Another practical disadvantage with prior art scrapers is the relative shortness of the handle member, thus making it difficult for a user to reach the center of the concave facing of the satellite dish to scrap debris, snow or ice therefrom. Moreover, a satellite owner utilizing conventional prior art scrapers will typically have to reach inward toward the center of the external concave surface of the satellite dish, thus frequently leaning against the body of the satellite dish and typically tilting or disturbing the precision alignment of the receiving facing of the satellite dish with the position of the orbiting satellite.

Similarly, using prior art scrapers, as generally described above, in an attempt to remove dust, debris, snow and/or ice from the internal concave facing of a satellite dish may cause the satellite owner serious injuries if the owner is compelled to lean against the sharp edges of the external periphery of the satellite dish.

BRIEF SUMMARY AND OBJECTS OF THE INVENTION

In view of the foregoing, it is a primary object of the present invention to provide a satellite cleaning apparatus and method which is capable of easily and conveniently removing dust, debris, snow and/or ice from the concave facing of a satellite dish.

It is also an object of the present invention to provide a satellite cleaning apparatus comprising a removable attachment member including a contacting surface having a configuration which substantially conforms to the concave facing surface of the satellite dish.

Further, it is an object of the present invention to provide a satellite cleaning apparatus which comprises an intermediate member having a curvilinear neck portion that extends substantially downward from a first end of the intermediate member to a second end thereof and thereby providing a complimentary angle of engagement for a contacting surface of an attachment member when applied against the concave facing of the satellite dish.

It is a still further object of the present invention to provide a satellite cleaning apparatus which provides means for reaching the center of the concave facing of the satellite dish for removing dust, debris, snow and/or ice without disturbing the receiving alignment of the satellite dish.

It is likewise an object of the present invention is to provide a satellite cleaning apparatus which is capable of protecting a user from injury when removing dust, debris, snow and/or ice from the facing of the satellite dish.

Consistent with the foregoing objects, and in accordance with the invention as embodied and broadly described herein, a satellite dish cleaning apparatus is disclosed in one embodiment of the present invention as including a handle member removably disposed within an elongated opening integrally formed at a first end of an intermediate member. The intermediate member is preferably formed having a substantially curvilinear neck portion which extends substantially downward at an angle between approximately 15° to 165° and having a tapering configuration from the first end to a second end of the intermediate member. Preferably, formed at the second end of the intermediate member is a retaining assembly for removably retaining a first end of an exchangeable attachment member. In addition, formed at a second end of the attachment member is a contacting surface having a configuration substantially conforming with the concave facing surface of a satellite dish. In the preferred embodiment, the contacting surface of the removable attachment member may comprise, for example, a rigid angular scraping or scooping means, a cleaning brush, or a resilient, elastomeric wiping material.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configuration. Thus, the following more detailed description of the embodiments of the system and method of the present invention, as described in FIGS. 1 through 4, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
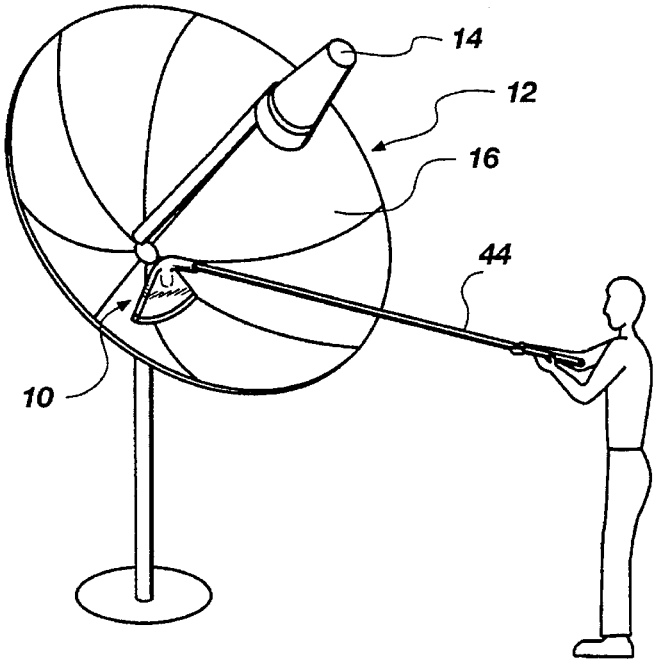
FIG. 1 is a perspective view of the satellite dish cleaning apparatus in accordance with one presently preferred embodiment of the present invention.
Figure 2:
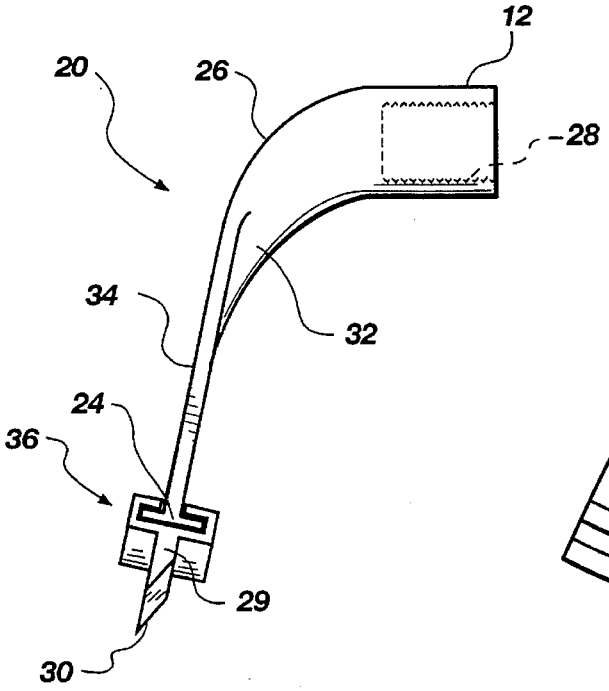
FIG. 2 is an elevated side view of the intermediate member removably disposed with the attachment member of one presently preferred embodiment of the satellite dish cleaning apparatus of the present invention.

One presently preferred embodiment of the satellite dish cleaning apparatus of the present invention, designated generally at 10, is illustrated in FIGS. 1 and 2. As shown, satellite dish cleaning apparatus 10 comprises a handle member 44 removably disposed within an elongated opening 28 formed in a first end 22 of an intermediate member 20. Intermediate member 20 is preferably formed having a curvilinear neck portion 26 which extends substantially downward from the first end 22 of intermediate member 20 in a tapering configuration whereby forming a linear extension member 34. Disposed in alignment with linear extension member 34 at a second end 24 of intermediate member 20 is a retaining assembly 36 for removably retaining a satellite dish engaging member 29 comprising a contacting surface 30 having a configuration substantially conforming with a concave surface 16 of a satellite dish 12.

Preferably, handle member 44 comprises an elongated body portion having a linear length substantially long enough in axial dimension to provide means for reaching the center axis of satellite dish 12. In current design, handle member 44 is preferably formed having a conventional telescoping body, however, other structural alternatives are possible. In addition, handle member 44 is preferably formed having a cross-sectional diameter sufficient for securely griping handle member 44 and for easily manipulating satellite dish cleaning apparatus 10 for removing dust, debris, snow and/or ice from concave facing 16 of satellite dish 12.

Handle member 44 is preferably formed of a rigid material which is sufficiently sturdy to withstand stress or force without permanent or serious deformation such as, for example, metal, plastic, wood, ceramic, fiberglass or any other suitable composite or polymeric material. Preferably, the rigid material comprising handle member 44 is comprised of a recyclable substance. It will be readily appreciated, however, that other configurations, shapes or materials of handle member 44 are possible.

Still referring to FIGS. 1 and 2, handle member 44 is preferably removably disposed within an elongated opening 28 integrally formed at the first end 22 of intermediate member 20. Preferably, intermediate member is formed of a rigid, non-resilient material such as, for example, metal, wood, plastic, fiberglass, graphite or other suitable composite or polymeric material that provides the necessary structural and functional integrity for removing dust, debris, snow and/or ice from the facing surface 16 of satellite dish 12. The material comprising intermediate member 20 is preferably comprised of a recyclable substance.

Elongated opening 28 formed at first end 22 of intermediate member 20 is preferably adapted in cross-sectional diameter to receive in alignment therewith a first end of handle member 44 by means of complimentary interactive threads which are formed on the exterior surface of the first end of handle member 44 and correspondingly formed on the internal surface of elongated opening 28, or vice versa. Alternatively, handle member 44 and intermediate member 20 can be formed as a single, one piece member. Moreover, those skilled in the art will readily recognize other suitable components and interactive means for disposing handle member 44 and intermediate member 20 within interactive relationship therebetween which are consistent with the spirit and scope of the present invention such as, for example, a conventional snap-fit relationship, etc.

Figure 3:
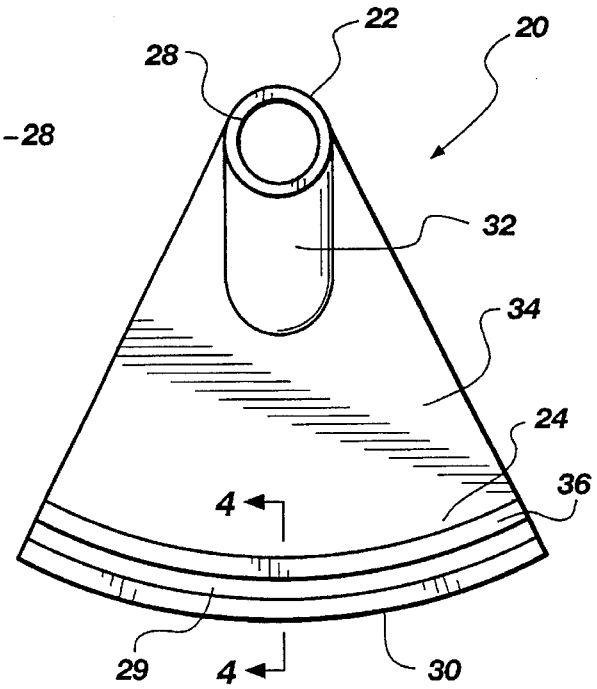
FIG. 3 is an elevated rear view of the intermediate member removably disposed with the attachment member of one presently preferred embodiment as illustrated in FIG. 2.

As best illustrated in FIGS. 2 and 3, curvilinear neck portion 26 of intermediate member 20 preferably extends at an angle approximately 120° from first end 22 of intermediate member 20. Further, curvilinear neck portion 26 is disposed in alignment with an extension member 34 having a substantially tapered body integrally disposed in configuration with second end 24 of intermediate member 20. In current design, curvilinear neck portion 26 is preferably formed having a substantially "L" shaped configuration providing an arcuate angle of engagement having a sufficient arch for easily manipulating satellite dish cleaning apparatus 10 while retaining handle member 44 in a position to prevent a receiver cone 14 or the concave facing surface 16 of satellite dish 12 from being damaged. Consistent therewith, the curvilinear configuration of neck portion 26 preferably comprises an angle of engagement between approximately 10° and 170° to provide means for scraping and/or scooping dust, debris, snow and/or ice from the concave facing 16 of satellite dish 12. It will be readily appreciated, however, that other shapes or configurations of curvilinear neck portion 26 are possible which are consistent with the spirit and scope of the present invention.

Integrally formed preferably along the under side of curvilinear neck portion 26 is a reinforcing structure 32 which provides means for supporting curvilinear neck portion 26 and extension member 34 of intermediate member 20 against the stress and forces being generated thereagainst when pushing and/or pulling satellite dish cleaning apparatus 10 across the concave facing 16 of satellite dish 12 in an effort to remove dust, debris, snow and ice therefrom. Preferably, reinforcing structure 32 is formed in an oval shape having a preferably thick enough cross-sectional area at the first end 22 of intermediate member 20 to provide the necessary structural support to intermediate member 20. Correspondingly, reinforcing structure 32 tapers substantially downward towards the midsection of extension member 34 of intermediate member 20, as illustrated in FIGS. 2 and 3. It will be readily appreciated by those skilled in the art, however, that reinforcing structure 32 can, of course, be formed of a wide variety of other configurations and shapes.

As briefly mentioned above, extension member 34 is preferably formed between curvilinear neck portion 26 and second end 24 of intermediate member 20. Preferably, linear extension member 34 comprises a substantially "V" shaped configuration having a reverse-tapered body from first end 22 to second end 24 of intermediate member 20. Moreover, second end 24 of intermediate member 20 forms an arcuate shape which conforms to the concave facing surface 16 of satellite dish 12. Consistent therewith, extension member 34 of intermediate member 20 provides an efficient excavating means for removing dust, debris, snow and/or ice from satellite dish 12. It will be readily appreciated, however, that extension member 34 of intermediate member 20 can, of course, be formed of a wide variety of suitable configurations, shapes and/or materials which are consistent with the spirit and scope of the present invention such as, for example, a rectangular body portion having an arcuate shape edge.

Figure 4:
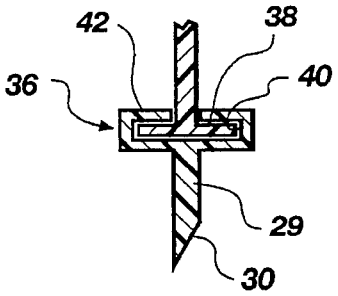
FIG. 4 is a cross-sectional view of presently preferred embodiment of the retaining assembly of one presently preferred embodiment of the satellite dish cleaning apparatus of the present invention.

Referring now to FIGS. 2 and 4, disposed in alignment with extension member 34 at the second end 24 of intermediate member 20 is a retaining assembly 36 for retaining a satellite dish engaging member 29 thereto. Preferably, satellite dish engaging member 29 is removably retained at the second end 24 of intermediate member 20, however, an alternate preferred embodiment of the present invention may comprise a permanent fixing means between intermediate member 20 and satellite dish engaging member 29.

In current design, preferably formed on the second end 24 of intermediate member 20 is an interlocking "T" shaped member 38 having a surface area slightly smaller than the cross-sectional periphery of an elongated channel 40 formed at a first end of satellite dish engaging member 29. Elongated channel 40 of satellite dish engaging member 29 is formed in a substantially "T" shaped configuration having a longitudinal operably conduit disposed between at least two raised rims 42 wherethrough extension member 34 can be removably passed when the second end 24 of intermediate member 20 is introduced therein. In this regard, satellite dish engaging member 29 is preferably removably retained at the second end 24 of intermediate member 20 by means of retaining assembly 36. Consistent therewith, strap attachments, adhesives, or other removable fastening means (i.e., rivets, screws, bolts, nails, etc.) may be used as possible alternatives to the preferred embodiment of retaining assembly 36. Accordingly, those skilled in the art will readily recognize other possible modifications and adaptations for retaining satellite engaging member 29 in removable engagement with intermediate member 20 which are consistent with the spirit and scope of the present invention.

Figure 5:
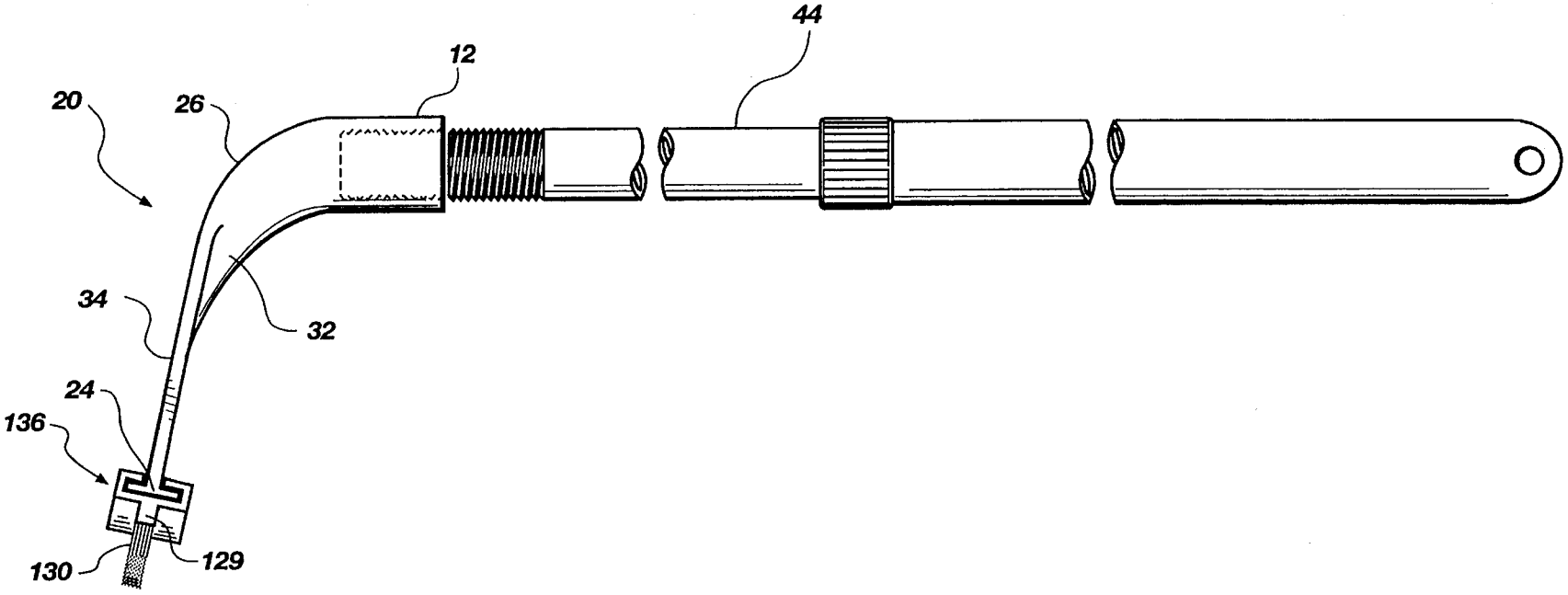
FIG. 5 is a perspective view of the satellite dish cleaning apparatus in accordance with an alternative presently preferred embodiment of the present invention.

Consistent with the foregoing, second end 24 of intermediate member 20 removably retains a satellite dish engaging member 29 having a contacting surface 30 comprising such as, for example, a rigid angular scraping and/or scooping means, a cleaning brush, a resilient, elastomeric material, etc., as shown in FIGS. 4 and 5. Preferably, contacting surface 30 of various alternate structural embodiments of satellite dish engaging member 29 are formed having a configuration substantially conforming to the concave facing surface 16 of satellite dish 12. In the case of a cleaning brush, it would include an engaging member (129), retaining assembly (136) and contacting surface (130) comprising a cleaning brush.

In current design, satellite dish engaging member 29 is formed of a rigid, non-resilient material such as, for example, metal, wood, plastic, fiberglass, graphite or other suitable composite or polymeric material that provides the necessary structural and functional integrity for removing dust, debris, snow and/or ice from the facing surface 16 of satellite dish 12. In one preferred embodiment of the satellite dish cleaning apparatus 10, the material comprising satellite dish engaging member 29 is preferably comprised of a recyclable substance.

In practice, handle member 44 is positioned in such a manner so as to operably engage contacting surface 30 of satellite dish engaging member 29 against the concave facing surface 16 of satellite dish 12, thereby providing an angle of engagement for scraping and/or removing dust, debris, snow and/or ice therefrom. Preferably, contacting surface 30 of satellite dish engaging member 29 is formed having a rigid angular edge. As shown in FIG. 3, contacting surface 30 of satellite dish engaging member 29 is preferably formed in a corresponding linear, arcuate shape to accommodate the concave configuration of facing surface 16 of satellite dish 12. It will be readily appreciated, however, that other configurations or shapes are possible.

From the above discussion, it will be appreciated that the present invention provides a satellite dish cleaning apparatus and method which is capable of easily and conveniently removing dust, debris, snow and/or ice from the concave facing of a satellite dish.

Unlike prior art cleaning devices, the present invention provides a satellite cleaning apparatus comprising a removable satellite dish engaging member including a contacting surface having a configuration which substantially conforms to the concave facing surface of a satellite dish. Similarly, the present invention provides a satellite cleaning apparatus including an intermediate member having a curvilinear neck portion which provides a complimentary angle of engagement for a contacting surface of the satellite dish engaging member when applied against the concave facing of the satellite dish.

In addition to foregoing, the satellite dish cleaning apparatus provides means for reaching the center of the concave facing of the satellite dish for scraping and removing dust, debris, snow and/or ice without tilting or disturbing the alignment of the satellite dish. Consistent therewith, the satellite cleaning apparatus of the present invention is capable of protecting a user from injurious contact with the external periphery of the facing of the satellite dish.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claim are to be embraced within their scope.

What is claimed and desired to be secured by United States Letters Patent is:

1. A satellite dish cleaning apparatus for removing dust, debris, snow and/or ice from a concave facing surface of a satellite dish, said satellite dish cleaning apparatus comprising:

a handle member having a first end, an elongated body and a second opposing end;

an intermediate member including a first end and a second end, said first end of said intermediate member comprising an elongated opening adapted to receive said first end of the handle member, said intermediate member further comprising a curvilinear neck portion formed between said first end and said second end, said curvilinear neck portion providing an angle of between approximately 10° and 170°; and a satellite dish engaging means including a first end having an elongated channel formed therein, said elongated channel adapted so as to interactively engage said second end of said intermediate member, said satellite dish engaging means including a second end comprising a contacting surface having a configuration substantially conforming to said concave facing surface of said satellite dish.

2. A satellite dish cleaning apparatus for removing dust, debris, snow and/or ice from a concave facing surface of a satellite dish as defined in claim 1 wherein said contacting surface comprises a rigid angular scraping means.

3. A satellite dish cleaning apparatus for removing dust, debris, snow and/or ice from a concave facing surface of a satellite dish as defined in claim 1 wherein said contacting surface comprises a resilient, elastomeric wiping material.

4. A satellite dish cleaning apparatus for removing dust, debris, snow and/or ice from a concave facing surface of a satellite dish, said satellite dish cleaning apparatus comprising:

a handle member having a first end, an elongated body and a second opposing end;

an intermediate member including a first end and a second end, said first end of said intermediate member comprising an elongated opening adapted to removably receive said first end of the handle member, said intermediate member further comprising a curvilinear neck portion formed between said first end and said second end, said curvilinear neck portion providing an angle of between approximately 10° and 170°; and a satellite dish engaging means including a first end having an elongated channel formed therein, said elongated channel adapted so as to interactively engage said second end of said intermediate member, said satellite dish engaging means including a second end comprising a contacting surface having a configuration substantially conforming to said concave facing surface of said satellite dish, wherein said contacting surface comprises a cleaning brush assembly.

5. A satellite dish cleaning apparatus for removing dust, debris, snow and/or ice from a concave facing surface of a satellite dish as defined in claim 4 wherein said intermediate member is formed of a rigid material sufficiently sturdy to withstand stress and force without permanent or serious deformation.

6. A satellite dish cleaning apparatus for removing dust, debris, snow and/or ice from a concave facing surface of a satellite dish as defined in claim 4 wherein said handle member is formed with telescoping features.

7. A method for removing dust, debris, snow and/or ice from a concave facing surface of a satellite dish, said method comprising the steps of:

providing a satellite dish cleaning apparatus comprising:

a gripping means having a first end, an elongated body and a second opposing end;

an intermediate member including a first end and a second end, said first end of said intermediate member adapted to receive said first end of said gripping means, said intermediate member having a curvilinear neck portion formed between said first end and said second end, said curvilinear neck portion providing an angle of between approximately 10° and 170°, and a satellite dish engaging means secured to said second end of said intermediate member, said satellite dish engaging means having a contacting surface formed having a configuration substantially conforming to said concave facing surface of said satellite dish;

holding said gripping means adjacent said second end thereof;

positioning said contacting surface of said satellite dish engaging means against said concave facing surface of said satellite dish;

and removing said dust, debris, snow or ice from said concave facing surface of said satellite dish with said contacting surface of said satellite dish engaging means.

* * * * *